US006963181B2

(12) United States Patent
Nakatera et al.

(10) Patent No.: US 6,963,181 B2
(45) Date of Patent: Nov. 8, 2005

(54) CATHODE-RAY TUBE, CATHODE-RAY TUBE APPARATUS, IMAGE DISPLAY APPARATUS, AND COIL UNIT

(75) Inventors: Shigeo Nakatera, Hirakata (JP); Tomohisa Mikami, Ibaraki (JP); Tetsuro Ozawa, Ibaraki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 149 days.

(21) Appl. No.: 10/437,210

(22) Filed: May 13, 2003

(65) Prior Publication Data

US 2004/0004427 A1 Jan. 8, 2004

(30) Foreign Application Priority Data

May 14, 2002 (JP) ..... 2002-138171

(51) Int. Cl.[7] ..... G09G 1/28

(52) U.S. Cl. ..... 315/368.28; 315/370; 315/368.25; 315/399; 335/299; 335/304

(58) Field of Search ..... 315/7, 8, 85, 370, 315/399, 368.27, 368.28, 382.1, 368.25; 335/282, 284, 299, 301, 304

(56) References Cited

U.S. PATENT DOCUMENTS 5,066,891 A * 11/1991 Harrold et al. ..... 315/8
6,404,133 B1 * 6/2002 Uchida et al. ..... 315/85

FOREIGN PATENT DOCUMENTS

JP 2002199412 A * 7/2002 ..... H04N/9/29

* cited by examiner

*Primary Examiner*—Haissa Philogene

(57) ABSTRACT

A color cathode-ray tube apparatus having: a glass bulb including a face panel, a funnel, and a neck; a deflection yoke attached to the funnel to surround thereof; and a color-selection electrode disposed inside the face panel. A pair of degaussing coils are wound around the upper and lower portions of the glass bulb, respectively. A loop coil, which is disposed around the glass bulb between the color-selection electrode and the deflection yoke, includes: a first portion including two extending portions of the loop coil positioned over and below the glass bulb respectively, each center of the extending portions being substantially in a plane perpendicular to a tube axial of the glass bulb; and a second portion including two bent portions that are formed by bending right and left sides of an original form of the loop coil toward the neck.

16 Claims, 16 Drawing Sheets

CATHODE-RAY TUBE, CATHODE-RAY TUBE APPARATUS, IMAGE DISPLAY APPARATUS, AND COIL UNIT

BACKGROUND OF THE INVENTION (1) Field of the Invention

The present invention relates to a cathode-ray tube, a cathode-ray tube apparatus, an image display apparatus, and a coil unit, specifically to a technology of correcting an image displayed on the cathode-ray tube having been affected by the terrestrial magnetism.

(2) Description of the Related Art

Color cathode-ray tube (CRT) apparatuses display images on the screen by allowing an electron gun to emit electron beams, which pass through passing holes of the color-selection electrode and reach the phosphor screen to which phosphors of red, green, and blue have been applied in advance at certain positions on which the electron beams are expected to land, allowing the phosphors at the landing positions to emit light of each color.

Here, an external magnetic field such as terrestrial magnetism (hereinafter, the external magnetic field is generically referred to as terrestrial magnetism) may act on the color CRT apparatuses to adversely affect the trajectory of the electron beams and inhibit the electron beams from landing on the phosphor screen at the expected positions. This is called "mislanding" or "landing deviation", which results in color drifts or the like in the image displayed on the screen.

For the purpose of preventing the landing deviations, a magnetic shield is provided in the CRTs. However, it is difficult for the magnetic shield to completely remove the effects of the terrestrial magnetism in every direction.

In particular, it is difficult for the magnetic shield to remove a component of the terrestrial magnetism that is in parallel to the tube axial of the CRT (hereinafter, the component is referred to as tube axial component).

When affected by the tube axial component of the terrestrial magnetism, the electron beams land on the phosphor screen shifting in a clockwise or counterclockwise rotation about the tube axial at the areas around the perimeter of the screen, depending on the direction of the magnetic pole of the affecting tube axial component of the terrestrial magnetism. When this happens, the image on the screen viewed from outside appears to be tilting.

For this reason, color CRT apparatuses generally provide a function to adjust the image tilt.

More specifically, as shown in FIG. 1, a loop coil 307 is wound around a funnel 303 of a glass bulb 305 constituting a CRT 301, where the loop coil 307 lies in a plane β that is perpendicular to a tube axial Z of the glass bulb 305.

In the above construction, the value of the current that is fed through the loop coil 307 is adjusted using a variable resistor 309 connected to a direct voltage source 308, generating a magnetic field MC to cancel out a tube axial component MH of the terrestrial magnetism. With this operation, the image tilt is corrected. Note that in FIG. 1, reference number 302 represents a face panel, 304 a neck, and 306 a deflection yoke.

The above-described method, however, is not a perfect solution to the screen image deficiency. That is to say, the magnetic field MC generated by the loop coil and the tube axial component MH of the terrestrial magnetism are not equal to each other in an opposite direction. As a result, though it may correct the image tilt in a visual check, it does not completely correct the landing deviation on the screen at the areas around the perimeter of the screen. That is to say, the color drift, a problem to be solved in improving the image quality, remains unsolved.

Intending to solve the above-described problem, Japanese Patent Publication No. 6-69221 discloses a color CRT apparatus that simultaneously performs the landing deviation correction and the image tilt adjustment.

This technology corrects the image tilt and reduces the amount of landing deviation (that is to say, the amount of deviation of the electron beams, which have landed actually, from the positions on the screen at which the electron beams are expected to land when there is no effect by the terrestrial magnetism), by adjusting a position P of the loop coil 307 along the tube axial Z, which is originally disposed in a plane β that is perpendicular to the tube axial Z.

More specifically, the document discloses an observation result that when the position P of the loop coil 307 is shifted toward the deflection yoke 306 along the tube axial Z, the sensitivity of the tilt correction improves, and the amount of landing deviation correction decreases, and that on the contrary, when the position P of the loop coil 307 is shifted toward the face panel along the tube axial Z, the sensitivity of the tilt correction decreases, and the amount of landing deviation correction increases. Based on this observation result, the patent document proposes that an optimal position of the loop coil 307 is obtained in advance along the tube axial through experiments, and that the loop coil 307 is disposed at the obtained optimal position at which the amount of landing deviation becomes the smallest when the loop coil 307 receives a direct current as intense as decreases the image tilt to "0".

The patent document states that it is possible to reduce the amount of landing deviation at the areas around the perimeter of the screen to a level that no color drift is observed, while correcting the image tilt.

However, there is a fear that this technology is incapable of coping with the high-definition and large-screen displays which are now in increasing demand. More specifically, with this technology, as the definition of the images on the color CRT apparatuses becomes higher or the screen becomes larger, the amount of landing deviation may increase to exceed the tolerance and the color drift may become more noticeable at the areas around the perimeter of the screen.

SUMMARY OF THE INVENTION

The first object of the present invention is therefore to provide a CRT that prevents the color drift over the whole screen by correcting the landing deviation accurately while at the same time adjusting the image tilt, canceling out the effect of the terrestrial magnetism. The second object of the present invention is to provide an image display apparatus having such a CRT.

The first object is fulfilled by a cathode-ray tube comprising: a glass bulb including a face panel, a funnel, and a neck; a color-selection electrode which is disposed inside the face panel; and a loop coil which is disposed around the glass bulb between the color-selection electrode and a position at which a deflection yoke is to be attached, a predetermined level of direct current being fed through the loop coil, wherein the loop coil includes a first portion and a second portion, the first portion including two extending portions of the loop coil positioned over and below the glass bulb respectively, each center of the two extending portions being substantially in a plane perpendicular to a tube axial of the glass bulb, and the second portion including two bent portions that are formed by bending a right side and a left side of an original form of the loop coil toward the neck respectively.

With the above-described construction, the loop coil includes the first portion and the second portion, the two portions not lying in the same plane, and the second portion being closer to the deflection yoke than the first portion is. This construction changes, in comparison with the conventional technology, a relationship between (i) the amount of landing deviation correction at the central areas of the upper and lower portions and (ii) the amount of landing deviation correction at the four corners of the screen. More specifically, with the present construction, the amount of landing deviation correction at the second portion, which is closer to the deflection yoke, is smaller than that at the first portion.

In other words, with the present construction, while the first portion increases the amount of landing deviation correction over the whole screen, the second portion reduces the amount of landing deviation correction at the four corners of the screen so as not to correct excessively, achieving a desired amount of landing deviation over the whole screen in balance.

The second object is fulfilled by an image display apparatus that comprises a cathode-ray tube apparatus that includes a cathode-ray tube and a deflection yoke, and displays an image on the cathode-ray tube apparatus in accordance with an image signal, wherein the cathode-ray tube including: a glass bulb including a face panel, a funnel, and a neck; a color-selection electrode which is disposed inside the face panel; and a loop coil which is disposed around the glass bulb between the color-selection electrode and the deflection yoke, a predetermined level of direct current being fed through the loop coil, wherein the loop coil includes a first portion and a second portion, the first portion including two extending portions of the loop coil positioned over and below the glass bulb respectively, each center of the two extending portions being substantially in a plane perpendicular to a tube axial of the glass bulb, and the second portion including two bent portions that are formed by bending a right side and a left side of an original form of the loop coil toward the neck respectively.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes a color cathode-ray tube (CRT) apparatus 1 in an embodiment of the present invention, with reference to the attached drawings.

Figure 2:
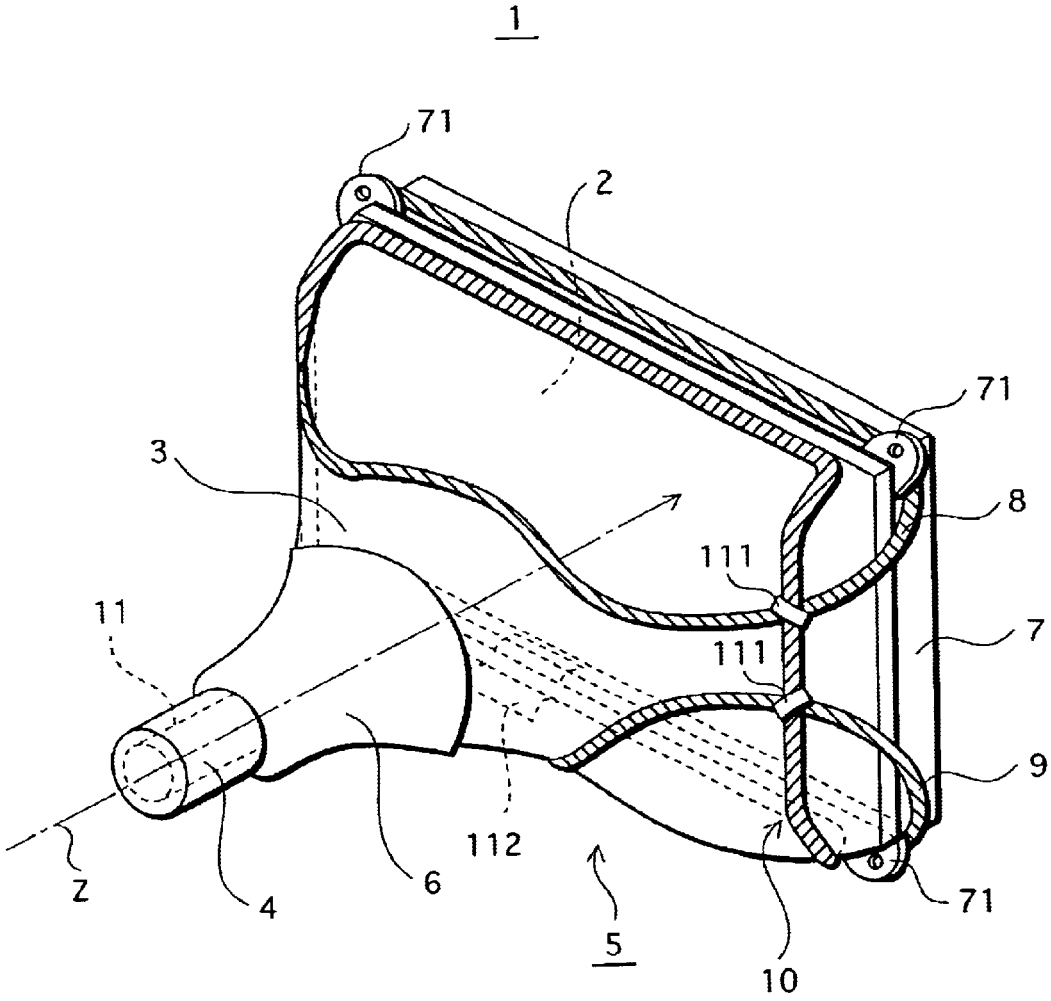
FIG. 2 is a perspective view showing the appearance of a color CRT apparatus in the embodiment of the present invention.

FIG. 2 is a perspective view showing the appearance of the color CRT apparatus 1.

As shown in FIG. 2, the color CRT apparatus 1 includes: a glass bulb 5 that includes a face panel 2, a funnel 3 connected to the back of the face panel 2, and a neck 4 connected to the back of the funnel 3; an electron gun 11 embedded in the neck 4; and a deflection yoke 6 that is attached to the funnel 3 to surround the end portion of the funnel 3 near the neck 4.

A metal tensile band 7 is attached to the rim of the face panel 2 to prevent the glass bulb 5 from imploding. An ear 71 is attached to each of the four corners of the tensile band 7. The ears 71 are used for attaching the CRT apparatus 1 to the body of a television apparatus.

A pair of degaussing coils 8 and 9 are wound around the upper portion and the lower portion of the glass bulb 5, respectively, to be substantially symmetric, as shown in FIG. 2. Each of the degaussing coils 8 and 9 is made by winding a conductive wire a plurality of turns to make a coil and covering the surface of the coil with, for example, insulation tape. The degaussing coils 8 and 9 are hooked around the ears 71 of the tensile band 7 and are positioned on the glass bulb 5.

An inner magnetic shield 15 (see FIG. 3) and the like are degaussed when an attenuation alternating current is fed through the degaussing coils 8 and 9 so as to generate an attenuation alternating magnetic field between the degaussing coils 8 and 9.

A loop coil 10 is also wound around the glass bulb 5, between a color-selection electrode 13 (see FIG. 3) and the deflection yoke 6. The loop coil 10 is made in a manner similar to that of the degaussing coils 8 and 9 by winding a conductive wire a plurality of turns to make a coil and covering the surface of the coil with, for example, insulation tape. The loop coil 10 is fixed to the degaussing coils 8 and 9 by tape 111 or the like at the intersections thereof and is thereby positioned on the glass bulb 5. The loop coil 10 is adhered to the bottom of the face panel 2 at the center thereof by adhesive tape 112 so as to prevent the loop coil 10 from hanging down and the loop shape from deforming.

Figure 3:
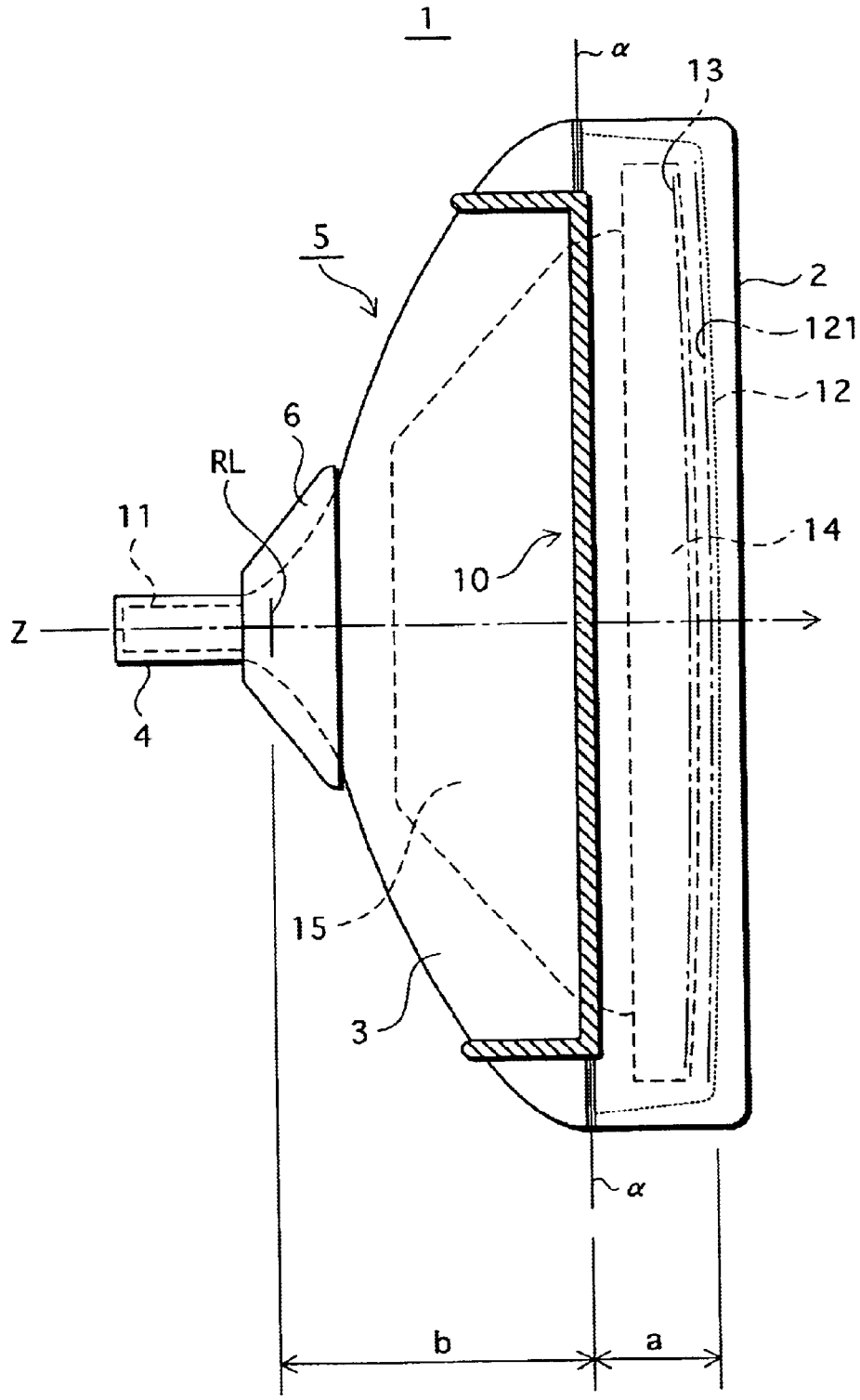
FIG. 3 is a top plan view of the CRT apparatus 1 shown in FIG. 2.

FIG. 3 is a top plan view of the CRT apparatus 1 shown in FIG. 2. It should be noted here that for the purpose of simply explaining the arrangement of the loop coil 10, the degaussing coils 8 and 9 and the tensile band 7 are omitted from FIG. 3.

As shown in FIG. 3, a horizontally extending portion of the loop coil 10 lies in a plane α (hereinafter referred to as "coil position reference plane α") that is perpendicular to the tube axial Z. The left-hand-side and the right-hand-side portions of the loop coil 10 are bent toward the deflection yoke 6 at an angle of approximately 90 degrees, to be substantially symmetric, as shown in FIG. 3.

It should be noted here that the expression such as "a coil lies in a certain plane" means that the center of the coil is substantially in the certain plane.

Red, green, and blue phosphors are applied to an inner surface 12 of the face panel 2 to form a phosphor screen 121. The color-selection electrode 13, which is, for example, a shadow mask, is disposed inside the face panel 2. The reference number 14 represents a frame that supports the color-selection electrode 13 by tension.

The reference number 15 represents the inner magnetic shield that prevents the terrestrial magnetism from entering inside and prevents a component of the terrestrial magnetism perpendicular to the tube axial from adversely affecting the trajectory of the electron beams.

Also, in FIG. 3, the mark "a" represents a distance, along the tube axial, between (i) an intersection of the inner surface of the face panel 2 and the tube axial and (ii) the coil position reference plane α in which long, horizontally extending portions of the loop coil 10 lie. The mark "b" represents a distance, along the tube axial, between the coil position reference plane α and a reference line RL of the glass bulb 5.

As will be described later, the present invention fully exerts the advantageous effects when the value "b/a" is set to an appropriate range.

Figure 4A:
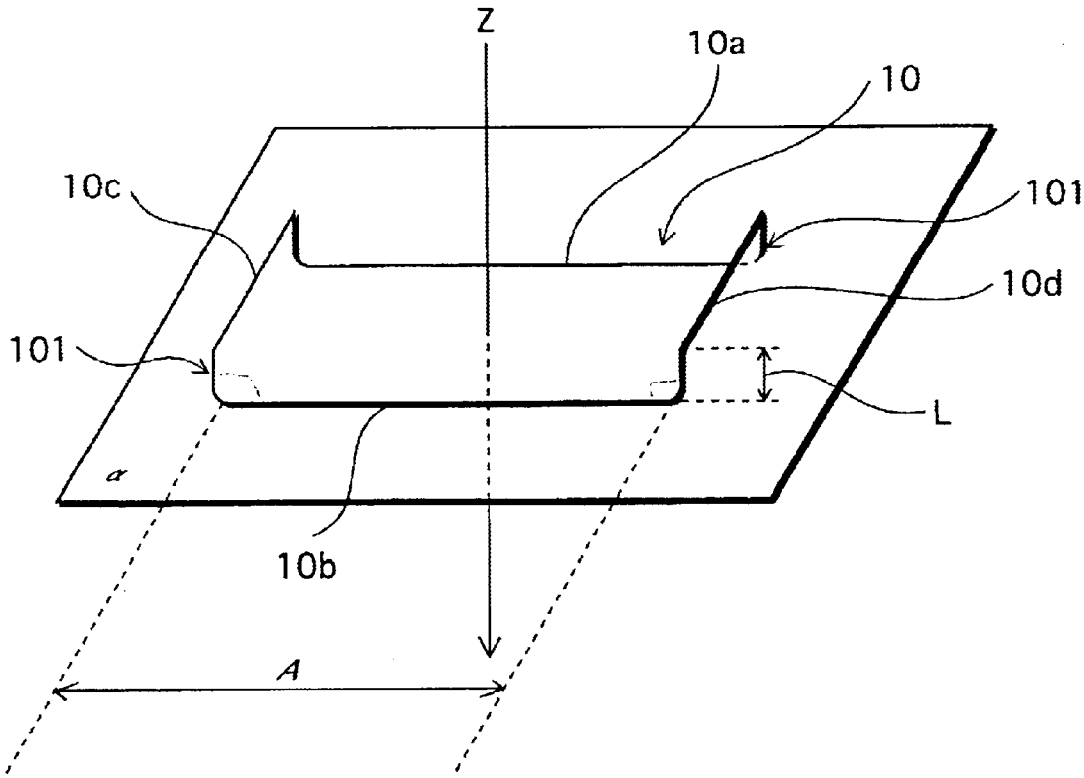
FIG. 4A shows the shape of the loop coil in the color CRT apparatus of the present invention.

FIG. 4A shows the shape of the loop coil 10 for detailed explanation thereof.

As shown in FIG. 4A, the loop coil 10 is formed by bending the two sides (the left-hand-side and the right-hand-side portions) of an approximately rectangular coil toward the deflection yoke 6 (upward, in FIG. 4A) so as to have two bent portions that look like steps. The loop coil 10 is positioned in the CRT apparatus 1 so that the long sides of the original rectangle lie in the coil position reference plane α, a plane perpendicular to the tube axial Z, and the short sides of the original rectangle in the bent portions are distant from the coil position reference plane α.

More specifically, the loop coil 10 has two bent portions 101 which are formed by bending an approximately rectangular coil toward the deflection yoke 6 at substantially the same positions on the long sides to be symmetrical.

The loop coil 10, having been formed as described above, includes long sides 10*a* and 10*b* that are positioned to include the coil position reference plane α. The loop coil 10 also includes the two bent portions 101 which contain short sides 10*c* and 10*g* of the original rectangle, respectively. The long sides 10*a* and 10*b* correspond to the first coil unit, and the bent portions 101 correspond to the second coil unit.

The amount of landing deviation correction is reduced at the bent portions 101, compared with the corresponding short sides in the conventional rectangular coil.

Accordingly, the long sides 10*a* and 10*b* are placed near the frit seal, where the face panel 2 is joined with the funnel 3 so that if a small amount of current is fed through the long sides 10*a* and 10*b*, a large amount of landing deviation is corrected there, and the short sides 10*c* and 10*d* are distanced from the frit seal so that a small amount of landing deviation is corrected at the bent portions 101.

With the above-described construction, the landing deviation can be corrected over the whole screen neither too much nor too little when the tilt of the image is corrected.

It should be noted here that the loop coil 10 shaped as shown in FIG. 4 is particularly effective when the color-selection electrode 13 is a mask (hereinafter referred to as "iron SST mask") that is formed by spanning tensed thin plates made of iron. The reason is as follows.

The iron SST mask is made so that each central area of the upper and lower portions has higher tension than the four corners of the screen, not to be affected by the vibration of the speaker or the like. However, since the iron has a negative magneto-striction coefficient, the central areas of the upper and lower portions with higher tension have lower magnetic property than the four corners.

As a result, the iron SST mask is, as a magnetic shield, less effective at the central areas of the upper and lower portions where the terrestrial magnetism is more apt to enter the CRT along the tube axial, increasing the amount of landing deviation.

However, this defect of the iron SST mask is overcome by the loop coil 10 of the present invention having the above-described construction in which, as shown in FIG. 4A, the long sides 10*a* and 10*b* are placed near the frit seal, where the face panel 2 is joined with the funnel 3 so that a large amount of landing deviation is corrected there, and the short sides 10*c* and 10*d* are distanced from the frit seal toward the deflection yoke 6 so that a small amount of landing deviation is corrected at the bent portions 101. Accordingly, application of the present invention to CRTs using the iron SST mask provides a large advantageous effect.

Figure 4B:
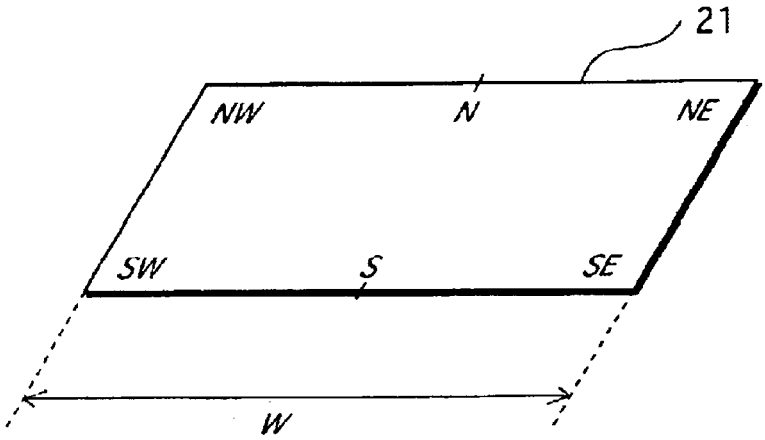
FIG. 4B is a perspective view of an effective screen.

The mark "A" in FIG. 4A represents the horizontal length of the horizontally extending portions of the loop coil 10, namely the long sides 10*a* and 10*b*. FIG. 4B is a perspective view of an effective screen 21 of the CRT apparatus 1. The mark "W" in FIG. 4B represents the horizontal length of the effective screen 21. As will be described later, it is preferable that the lengths A and W satisfy a certain relationship so that the loop coil 10 of the present embodiment provides a certain level of effect.

It should be noted here that in general, "an effective screen" is defined as "an area in which images are displayed, the area being a part of the face panel".

Now, results of a comparative experiment for the image tilt adjustment and the landing deviation correction will be described with reference to FIGS. 5A to 5F.

The color CRT apparatus of the present embodiment used in this experiment was of a 32-inch type (length W=66 cm), the color-selection electrode was an iron SST mask, the loop coil was made by winding a conductive wire being 0.4 mm in diameter 160 turns to make a coil being 2,200 mm in inside perimeter length, forming the coil to be substantially rectangular, placing the long sides of the rectangular coil near the frit seal, and as shown in FIG. 4A, bending the long sides of the rectangular coil toward the deflection yoke at positions 80 mm distant from the short sides so that "L", which represents the length of each bent portion 101 along the tube axial, is 80 mm.

In this experiment, the distances "a" and "b", both shown in FIG. 3, were 9 cm and 23 cm, respectively, and the length "A" shown in FIG. 4A as the horizontal length of the loop coil 10 was 60 cm.

A comparative example was also prepared. The comparative example is a color CRT apparatus having a loop coil placed to surround the glass bulb near the frit seal (see FIG. 1). Otherwise, the comparative example is identical with the color CRT apparatus of the present embodiment.

Figure 5A:
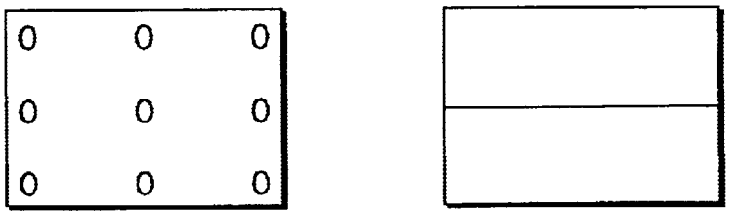
FIGS. 5A–5F show the amount of electron beam landing deviation and the image tilt in the color CRT apparatuses of the present embodiment and the comparative example.
Figure 5B:
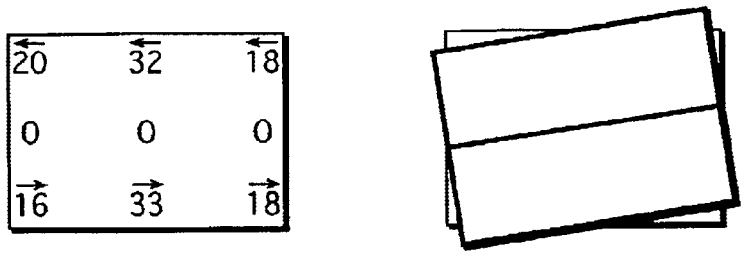
Figure 5C:
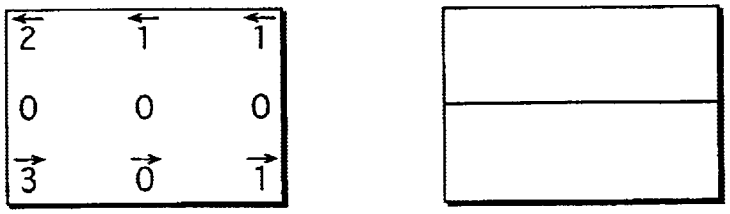
Figure 5D:
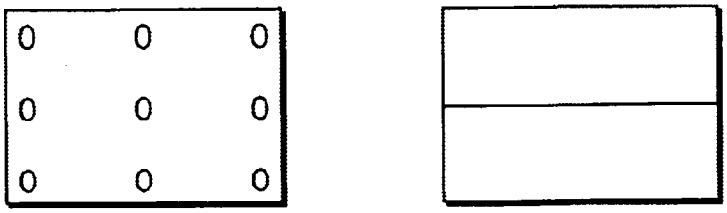
Figure 5E:
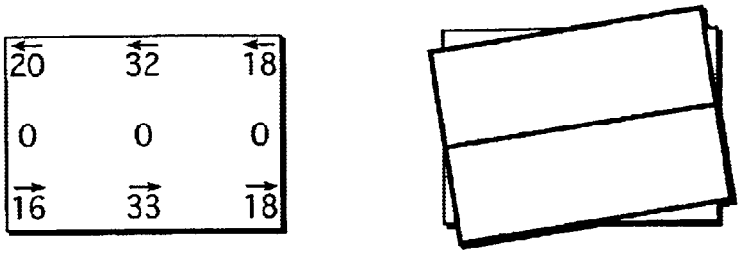
Figure 5F:
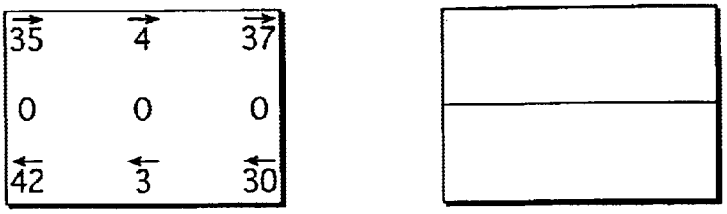

FIGS. 5A–5C show measurement results of the amount of electron beam landing deviation ($\mu$m) and the image tilt in the case where the loop coil 10 in the present embodiment was used. FIGS. 5D–5F show measurement results of the amount of electron beam landing deviation ($\mu$m) and the image tilt in the case where the loop coil of the comparative example was used.

In the measurement for both apparatuses, the terrestrial magnetism along the tube axial was 50 $\mu$T.

The comparative experiment was conducted as follows.

First, a degaussing process is performed in the environment where no magnetic field exists. That is to say, magnetic substances in the glass bulb, such as the color-selection electrode, the frame, and the inner magnetic shield, are degaussed by feeding an attenuation alternating current through the degaussing coils for a certain time period.

Next, the landing positions of the electron beams were measured, and the measured landing positions were determined as the reference values (the amount of deviation is zero). FIGS. 5A and 5D show the reference values, respectively. In this process, the deflection yoke was fixed so that no image tilt occurs. As a result, no image tilt occurred.

Next, the landing positions of the electron beams were measured after a degaussing process was performed while the color CRT apparatuses faced toward north, and the tube axial was along the north-south direction. FIGS. 5B and 5E show the measurement results. Both images displayed on the screen were tilting under the influence of the terrestrial magnetism.

Next, to correct the image tilt, a certain level of direct current was fed through the loop coil, and a degaussing process was performed while the color CRT apparatuses faced toward north, and the tube axial was along the north-south direction.

More specifically, when a direct current is fed through the loop coil, a magnetic field is established. The magnetic field exerts a force in an opposite direction to the Lorentz force exerted by the terrestrial magnetism along the tube axial. As a result, the Lorentz force acted upon the electron beams is cancelled out by the force received from the magnetic field established by feeding the direct current through the loop coil, enabling the image tilt to be corrected.

Here, in the case where the loop coil in the present embodiment was used, landing deviations were appropriately corrected over the whole screen, as shown in FIG. 5C. In contrast, in the case where the loop coil of the comparative example was used, the absolute values of the landing deviation became smaller in the central areas of the upper and lower portions, but the deviation was excessively corrected to become larger than before at the four corners, as shown in FIG. 5F.

As described above, it was confirmed that with the construction of the present embodiment having the loop coil 10 in a shape as shown in FIG. 4A and its horizontally extending portion being in the coil position reference plane $\alpha$, the landing deviation can be corrected over the whole screen neither too much nor too little when the tilt of the screen is corrected, and high-quality images with less color drift can be obtained, compared with the case where a conventional loop coil is used.

The following are discussions of a preferable position of the loop coil 10 and its shape, based on the experiment results.

Preferable Positioning of Loop Coil 10

First, a preferable position of the loop coil 10 will be discussed in relation to the position of the coil position reference plane $\alpha$ along the tube axial.

As mentioned in the "Description of the Related Art", it has been found that in general, as the loop coil comes closer to the face panel, the sensitivity of the tilt correction degrades, but the amount of landing deviation correction increases, and that on the contrary, as the loop coil moves toward the deflection yoke, the sensitivity of the tilt correction improves, but the amount of landing deviation correction decreases.

It is accordingly considered that the sensitivity of the tilt correction and the amount of landing deviation correction vary depending on the distance "a" (a distance between (i) an intersection of the inner surface of the face panel 2 and the tube axial and (ii) the coil position reference plane $\alpha$: see FIG. 3), but more precisely, depending on a relative relationship between the distance "a" and a distance between the deflection center and the loop coil 10.

Since the position of the deflection center along the tube axial is substantially identical with the reference line RL shown in FIG. 3, the distance between the deflection center and the loop coil 10 can be represented as the distance "b" (a distance, along the tube axial, between the coil position reference plane $\alpha$ and the reference line RL). As a result, in correspondence with desired values of the sensitivity of the tilt correction and the amount of landing deviation correction, an optimal range of a ratio b/a is obtained.

Figure 1:
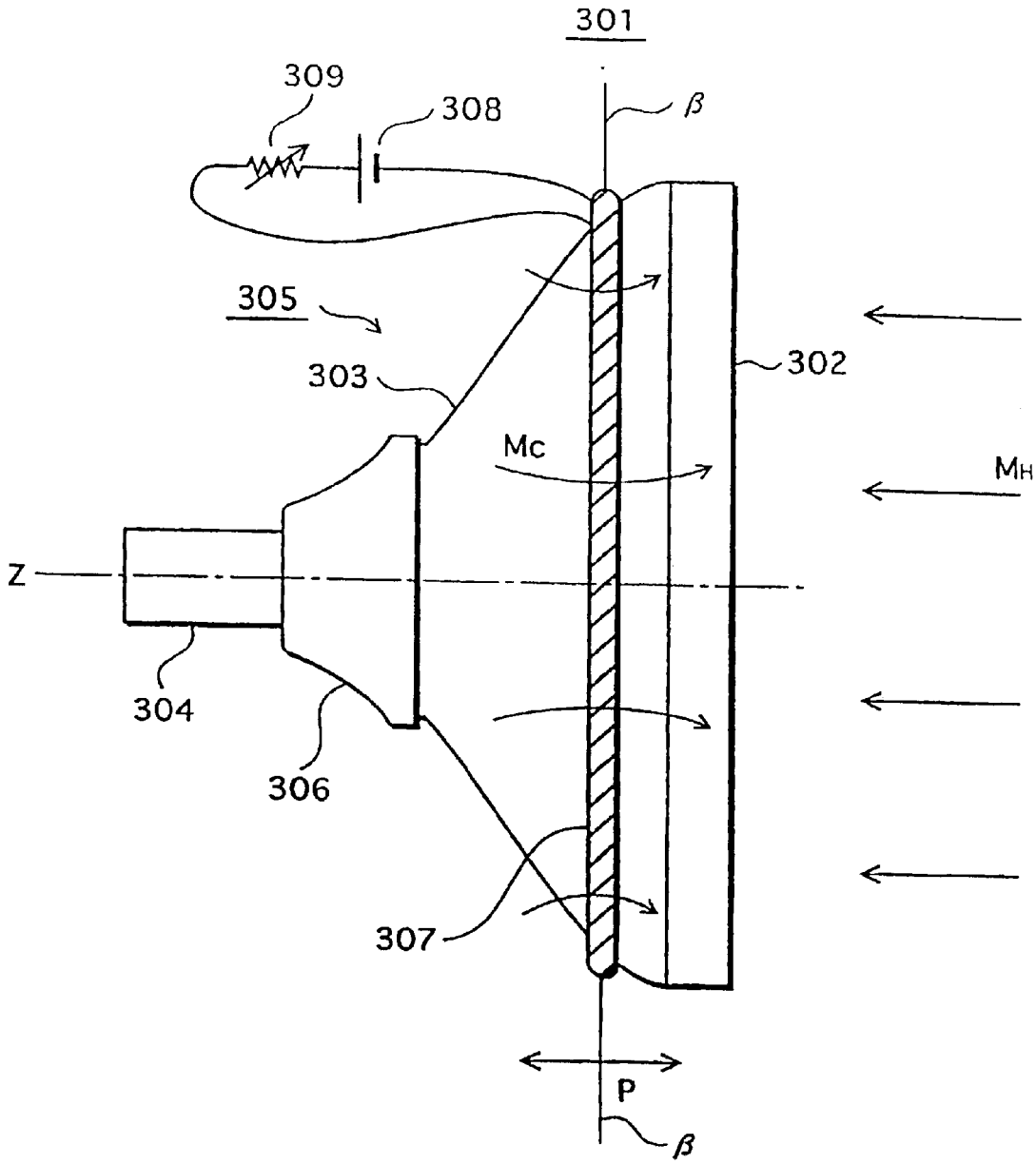
FIG. 1 PRIOR ART
FIG. 1 shows the shape of a loop coil in a conventional color CRT apparatus.

For this purpose, an experiment was conducted for larger CRT apparatuses of 29-inch, 32-inch, 34-inch, and 36-inch types having the same construction as the CRT apparatus 1 shown in FIG. 2. In the experiment, for each of different values of b/a, the image tilt was corrected by feeding various amounts of current through the loop coil (in this experiment, a rectangular loop coil as shown in FIG. 1 was used) at various positions, and the amount of landing deviation for each tilt correction was measured at fields "N" and "S" (central areas of upper and lower portions of the effective screen: see FIG. 4*b*). A preferable range of the ratio b/a was obtained based on the results of the experiment.

Figure 6:
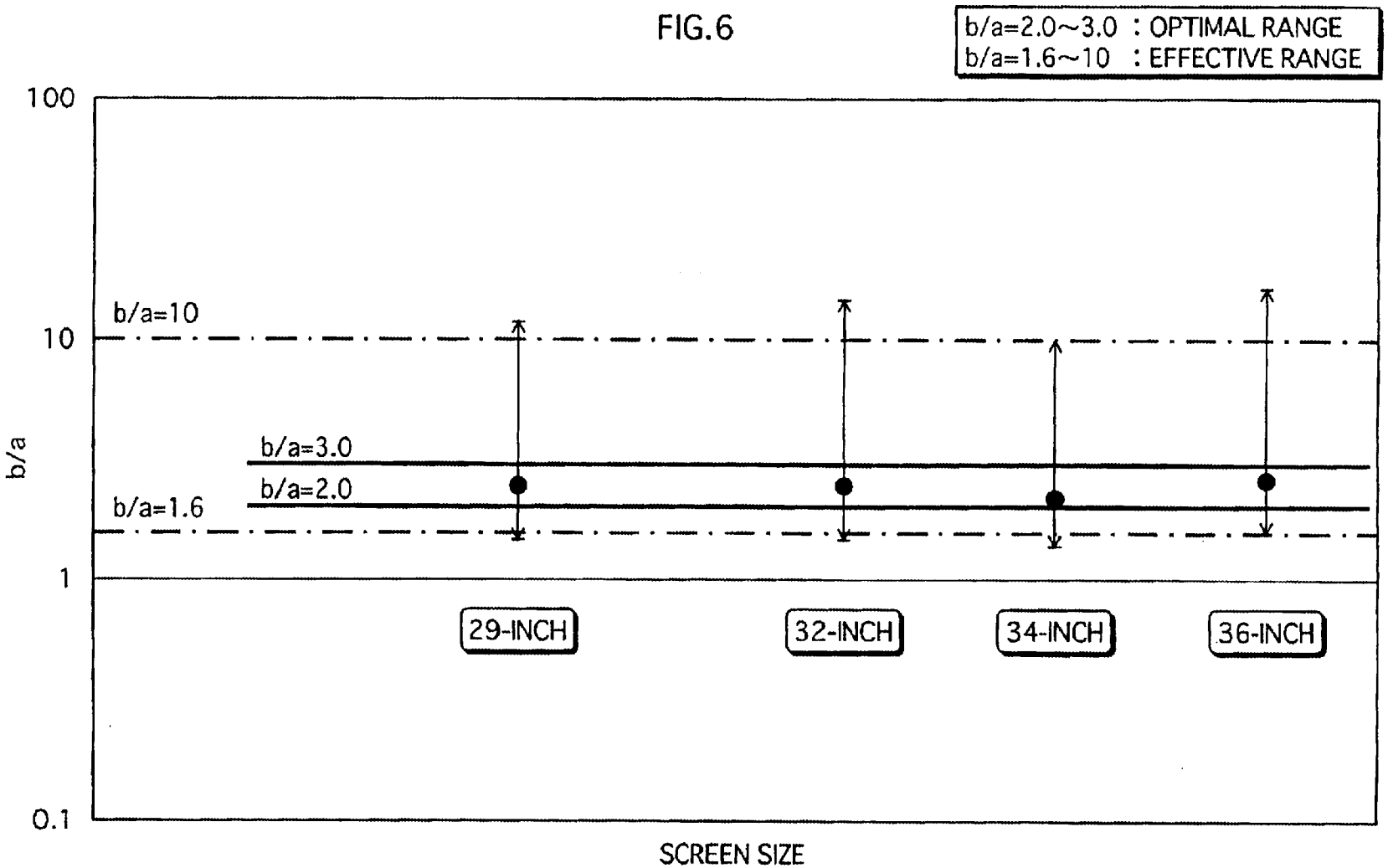
FIG. 6 shows a preferable range of the loop coil attachment position.

FIG. 6 shows the results of the experiment.

In FIG. 6, the horizontal axis represents the screen size, and the vertical axis represents the values of the ratio b/a.

When the values of the ratio b/a are in the ranges indicated by the vertical arrows, the amount of landing deviation measured at the fields N and S is smaller than the case where the loop coil is not provided. An area common to these ranges is shown by the two dashed lines. The optimal range of the values of the ratio b/a is, therefore, from 1.6 to 10, inclusive.

This indicates that the effect of decreasing the amount of landing deviation at the fields N and S is provided by each of the CRT apparatuses of different sizes used in the experiment meeting the condition "$1.6 \leqq b/a \leqq 10$", compared with the case where the loop coil is not provided.

Further, when the values of the ratio b/a are in the range between the two thick solid lines (b/a=2.0 and b/a=3.0)

inclusive, the amount of landing deviation measured at the fields N and S is in a range from −10 μm to +10 μm in each CRT apparatus of any size.

For information, the width of the stripe of the phosphor of each color in the phosphor screen in a color CRT apparatus having the highest definition currently is 0.55 mm. When the amount of landing deviation is no larger than 20 μm, no color drift is observed. As a result, a very advantageous effect is provided when the amount of landing deviation measured at the fields N and S is in a range from −10 μm to +10 μm.

The major points of the above description are summarized as follows.

The effect of decreasing the amount of landing deviation at the fields N and S is provided when the position of the coil position reference plane α is set to meet the following condition:

$$1.6 \leqq b/a \leqq 10 \quad (1)$$

Further, a more desirable effect is provided when the position of the coil position reference plane α is set to meet the following condition:

$$2.0 \leqq b/a \leqq 3.0 \quad (2)$$

Preferable Shape of Loop Coil

1. Range of Horizontal Length a of Loop Coil

The length A should also be determined in relative relation to the size of the CRT apparatus, in particular, in relative relation to the length W (horizontal length of the effective screen). This is because the present invention aims to solve the problem of the imbalance in the amount of landing deviation correction between the fields N and S and the four corners of the screen, and the imbalance varies depending on the relative relationship between the length W and the length A, in other words, the positions at which the bent portions 101 are formed.

To have the amount of landing deviation correction be within tolerance at both the fields N and S and the four corners of the effective screen, it is preferable to take into consideration a ratio in the amount of landing deviation between the fields N and S and the four corners in the case where the loop coil 10 is not provided.

Figure 7:
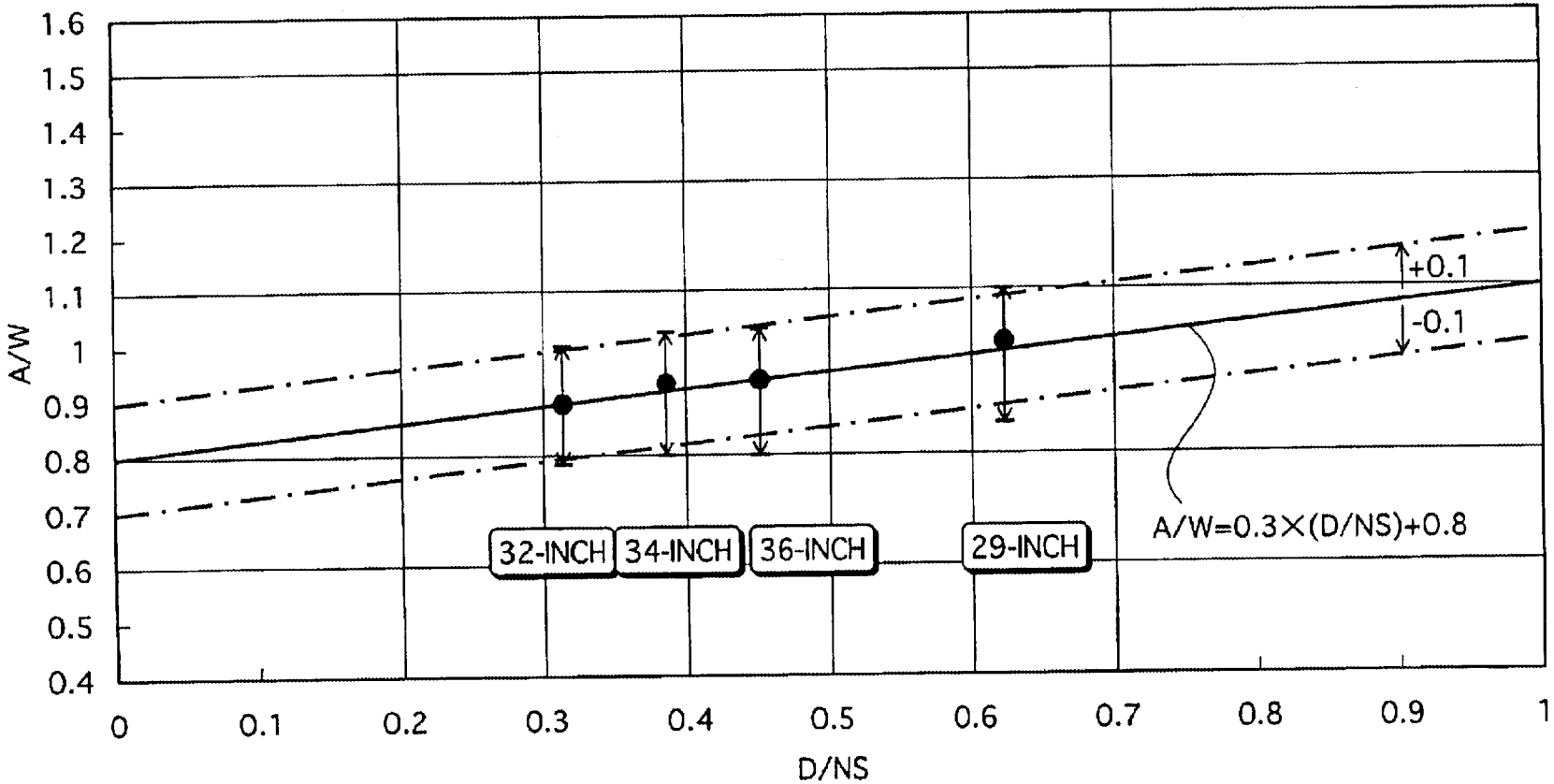
FIG. 7 shows a preferable range of the horizontal length of the loop coil.

For this purpose, the following experiment was conducted. First, the amount of landing deviation was measured at the four corners (fields NE, NW, SE, and SW shown in FIG. 4B) of the effective screen in the CRT apparatus while no current was applied. Here, the average value of the measurement results is referred to as "D". Then, a ratio D/NS was obtained, where "NS" represents the average value of the landing deviation measured at the fields N and S (central areas of upper and lower portions of the effective screen). Then a relationship between the value D/NS and A/W was studied, where "A/W" represents a ratio of the length A to the length W. FIG. 7 shows the results of the experiment.

In this experiment, the values of b/a were set to meet the condition (2) (more particularly, to the values indicated by the large dots in FIG. 6), and the length L was set to approximately 0.12A.

In FIG. 7, the horizontal axis represents the values of D/NS, and the vertical axis represents the values of A/W.

Here, the following equation is obtained from a straight line that is drawn by connecting the large dots in FIG. 7 representing the smallest values of the absolute value (referred to as "D") of the values D measured for the CRT apparatuses of the different sizes after the loop coil was used to correct the landing deviation.

$$A/W = 0.3 \times (D/NS) + 0.8 \quad (3)$$

Here, when an absolute value D' is smaller than an absolute value of a value D measured while no tilt correction is made and no current is applied to the loop coil 10, it indicates that a certain level of advantageous effect has been obtained. Based on this judgment, a range of values of the ratio A/W meeting the above condition (3) was checked for each of the CRT apparatuses of the different sizes. The obtained ranges are indicated by the vertical arrows in FIG. 7. Then, two lines were drawn to show an area that is common to the obtained ranges. It was then found that the upper line indicating the upper limit of the area is obtained by shifting the line represented by the equation (3) upward by 0.1 parallel to itself, and represented by the following equation.

$$A/W = 0.3 \times (D/NS) + 0.9$$

It was also found that the lower line indicating the lower limit of the area is obtained by shifting the line represented by the equation (3) downward by 0.1 parallel to itself, and represented by the following equation.

$$A/W = 0.3 \times (D/NS) + 0.7$$

Accordingly, a condition that should be met for the amount of landing deviation measured at the four corners after correction with the loop coil to be smaller than the case where no loop coil is used is represented by the following equation.

$$F(D/NS) - 0.1 \leqq A/W \leqq F(D/NS) + 0.1 \quad (4)$$

In the equation (4), F(D/NS)=0.3×(D/NS)+0.8

Since the values of D and NS are obtained from an actual measurement and the values of W are uniquely determined for the different sizes of the CRT apparatus 1, the values of "A" meeting the equation (4) can be obtained with ease.

It should be noted here that the reason why an area for advantageous effects was obtained not with reference to the amount of landing deviation at the four corners after correction by a conventional loop coil shown in FIG. 1 but with reference to the amount of landing deviation without any correction by a loop coil is that, as is understood from comparison between FIGS. 5E and 5F, the absolute values of the landing deviation in the case where no correction is made by a loop coil are smaller than the case where a correction is made by the conventional loop coil. It is considered from this that if the amount of landing deviation at the four corners is improved in comparison with the case where no correction is made by a loop coil, the amount of landing deviation is always improved in comparison with the case where a correction is made by a conventional loop coil. This consideration is also applied to the following experiment.

2. Range of Preferable Values of Length L

Figure 8:
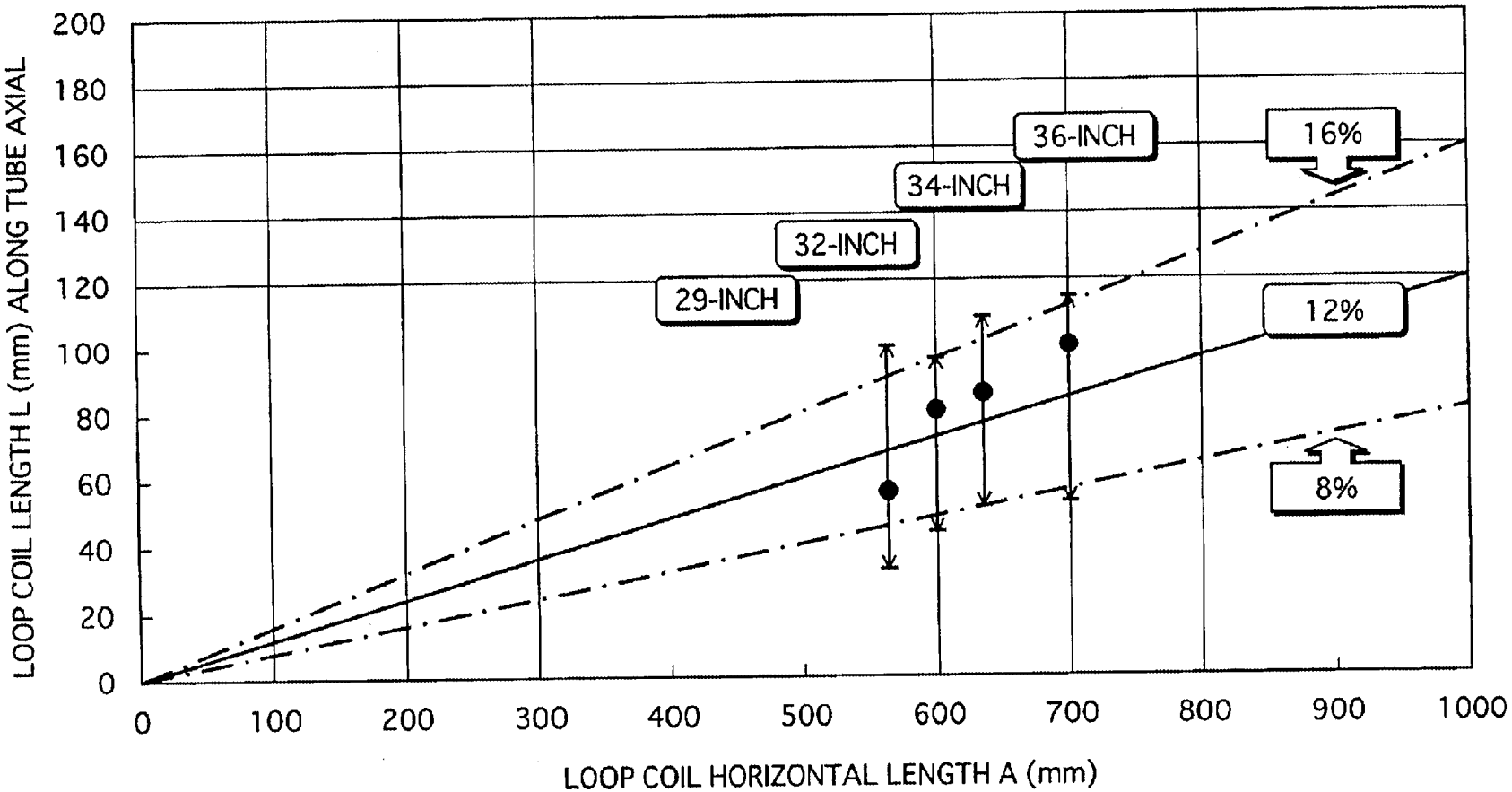
FIG. 8 shows a preferable range of the length of the bent portions along the tube axial.

Following the above experiment, the amount of improvement in correcting the landing deviation at the four corners was studied to obtain a range of preferable values of the length L of the bent portions in relation to the horizontal length A of the loop coil. FIG. 8 shows the experiment results.

The values of b/a and A/W used in this experiment are equivalent to those indicated by the large dots in FIGS. 6 and 7 for CRT apparatuses of different sizes.

In FIG. 8, the ranges indicated by the vertical arrows for the different sizes are ranges of the values L in which the correction of landing deviation at the four corners is improved. That is to say, if a value L is larger than the range, the bent portions do not function in correcting the landing deviations at the four corners. On the contrary, if a value L is smaller than the range, the loop coil of the present embodiment loses its merits over the conventional loop coil and corrects the landing deviations at the four corners excessively.

Then, an area common to the ranges of improvement for each CRT apparatus was obtained. The upper limit of the common area is L=0.16A, and the lower limit is L=0.08A.

Accordingly, it can be said that if the following condition is met, the amount of correcting the landing deviation at the four corners is improved in comparison with the conventional loop coil.

$$0.08 \leqq L/A \leqq 0.16 \quad (5)$$

Figure 9:
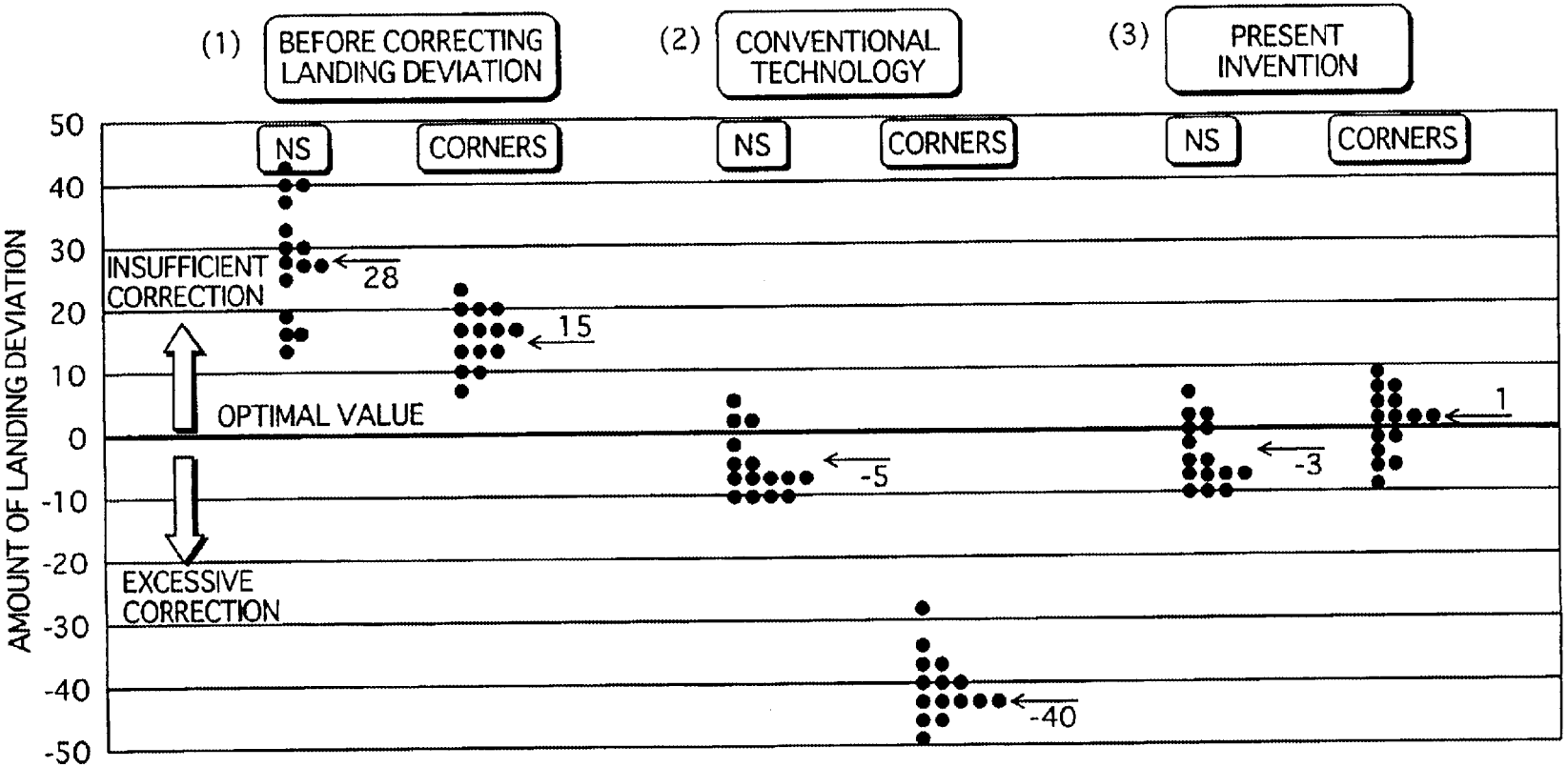
FIG. 9 shows results of comparative experiments conducted on the CRT apparatuses of the present invention and the conventional technology.

FIG. 9 shows results of comparative experiments conducted to show the advantageous effects of the CRT apparatus 1 in the present embodiment.

In FIG. 9, (1) "Before Correcting Landing Deviation", (2) "Conventional Technology", and (3) "Present Invention" are, respectively, a plot of the measured values of the amount of landing deviation at the fields N and S and the four corners, in the cases where (1) no loop coil was used, (2) the loop coil shown in FIG. 1 was used, and (3) the loop coil of the present embodiment, which was set to the preferable values shown in FIGS. 6, 7, and 8, was used.

It should be noted here that the experiment was conducted a plurality of times for each of the CRT apparatuses of different sizes and that the values under the arrows are averages of the values indicated by the dots of the corresponding dot groups, respectively.

As will be understood from FIG. 9, the CRT apparatuses of the present invention showed excellent results, with the values of landing deviation being within the range from −10 μm to +10 μm at both the fields N and S and the four corners.

It should be noted here that though the conditional expressions (1), (4), and (5) were obtained from the experiments which were conducted on CRT apparatuses of typical sizes, namely 29-inch, 32-inch, 34-inch, and 36-inch types, it was confirmed through the experiments that CRT apparatuses of other sizes also improve the amount of landing deviation at the fields N and S and the four corners in so far as they meet the conditional expressions (1), (4), and (5), at least in comparison with the case where the conventional loop coil is used.

Image Display Apparatus

Figure 10:
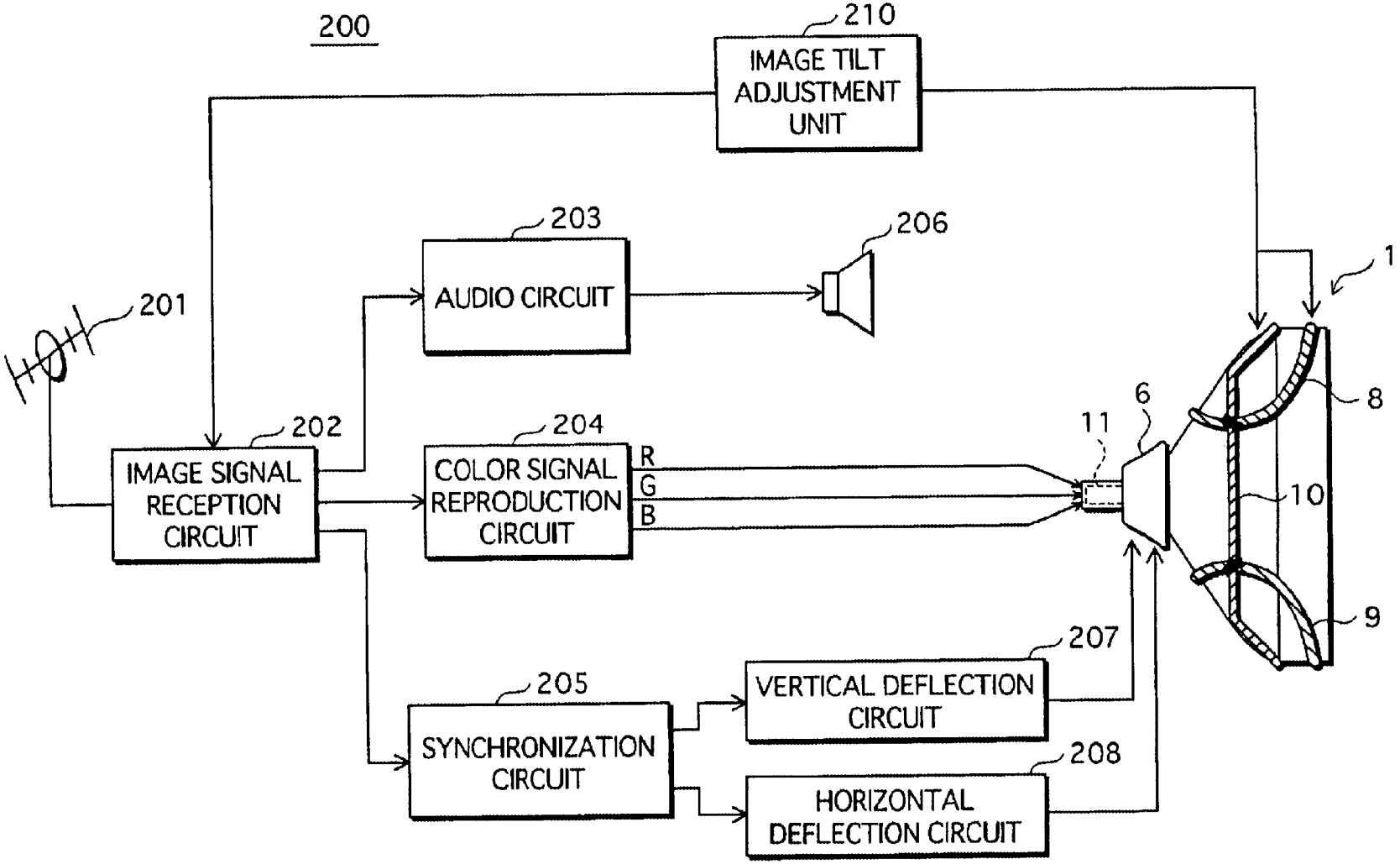
FIG. 10 shows the construction of a television receiver having the color CRT apparatus of the present invention.

FIG. 10 is a block diagram showing the circuit construction of a television receiver 200, an example of an image display apparatus, to which the color CRT apparatus 1 is applied.

As shown in FIG. 10, the television receiver 200 includes an image signal reception circuit 202, an audio circuit 203, a color signal reproduction circuit 204, a synchronization circuit 205, a speaker 206, a vertical deflection circuit 207, a horizontal deflection circuit 208, an image tilt adjustment unit 210, and the color CRT apparatus 1.

The image signal reception circuit 202 receives a television signal via an antenna 201, detects and separates the television signal into an audio signal, an image signal, and a synchronization signal, and sends the signals to the audio circuit 203, the color signal reproduction circuit 204, and the synchronization circuit 205, respectively.

The audio circuit 203 drives the speaker 206 and reproduces the sounds in accordance with the received audio signal.

The color signal reproduction circuit 204 demodulates color signals of red (R), green (G), and blue (B) in accordance with the received image signal, and causes the in-line electron gun 11 of the color CRT apparatus 1 to emit three electron beams of R, G, and B by applying voltages to the electron gun 11 in correspondence with the color signals of R, G, and B, respectively.

The synchronization circuit 205 separates the synchronization signal into a vertical synchronization signal and a horizontal synchronization signal, and outputs the signals to the vertical deflection circuit 207 and the horizontal deflection circuit 208, respectively. The vertical deflection circuit 207 and the horizontal deflection circuit 208 generate sawtooth currents in accordance with the input synchronization signals, and supply the sawtooth currents to a vertical deflection coil and a horizontal deflection coil (both not illustrated) in the deflection yoke 6 as a vertical deflection current and a horizontal deflection current, respectively. This allows the electron beams of each color to be deflected regularly, and the phosphor screen 121 (see FIG. 3) to be raster-scanned.

The image tilt adjustment unit 210 adjusts the image tilt and the amount of landing deviation in accordance with a user input.

Figure 11:
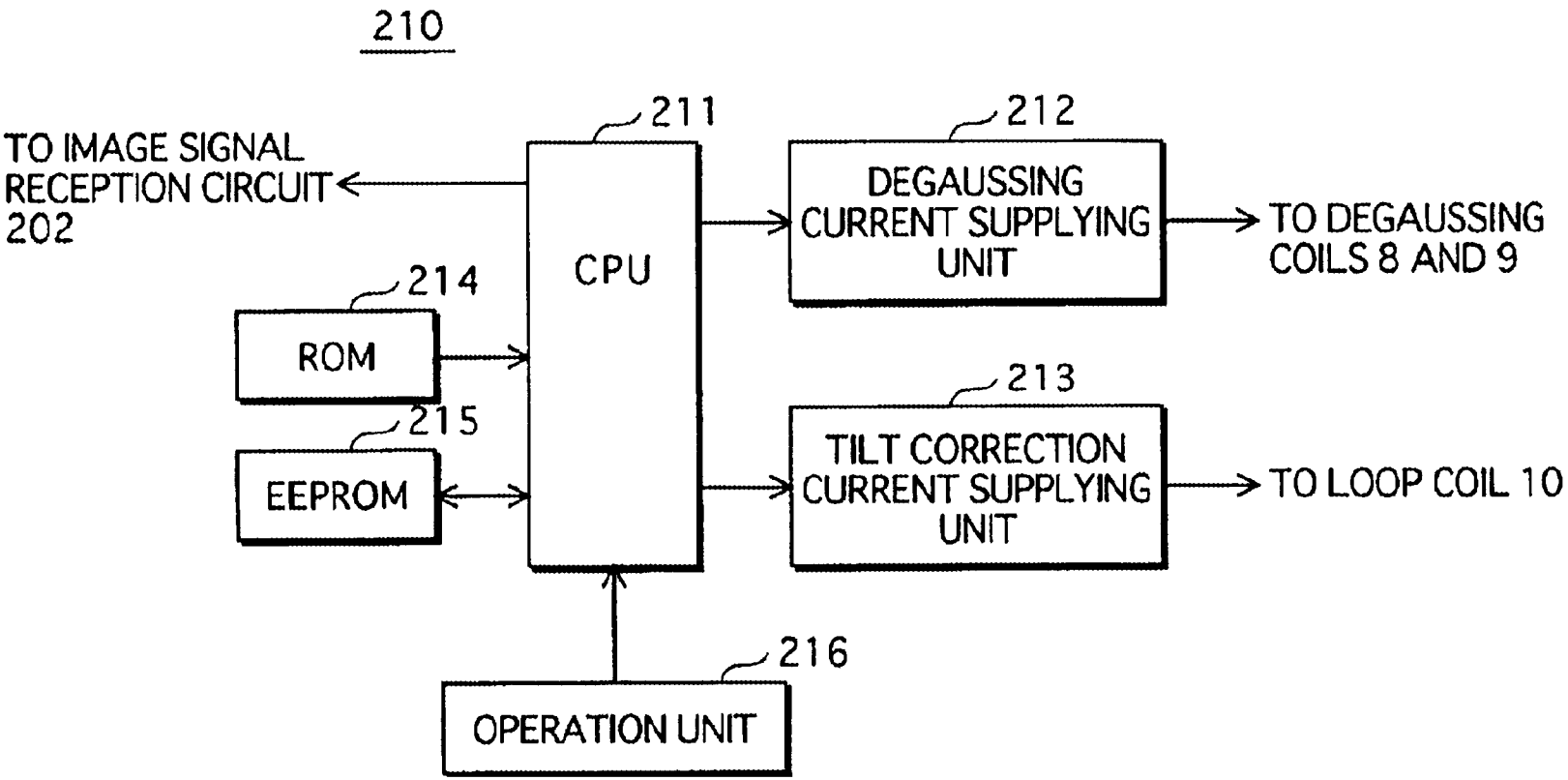
FIG. 11 is a block diagram showing the construction of the image tilt adjustment unit.

FIG. 11 is a block diagram showing the construction of the image tilt adjustment unit 210.

As shown in FIG. 11, the image tilt adjustment unit 210 includes a CPU 211, a degaussing current supplying unit 212, a tilt correction current supplying unit 213, a ROM 214, an EEPROM 215, and an operation unit 216.

The degaussing current supplying unit 212 supplies an attenuation alternating current to the degaussing coils 8 and 9 for a certain time period in accordance with an instruction by the CPU 211.

The tilt correction current supplying unit 213 adjusts the image tilt by varying the intensity and the direction of the current fed through the loop coil 10, in accordance with a user input received via the operation unit 216.

The ROM 214 stores a control program for the tilt adjustment and image data of a horizontal pattern. The EEPROM 215 holds a value of the current fed through the loop coil 10, the current value being the final one having been determined through the tilt adjustment.

Figure 12:
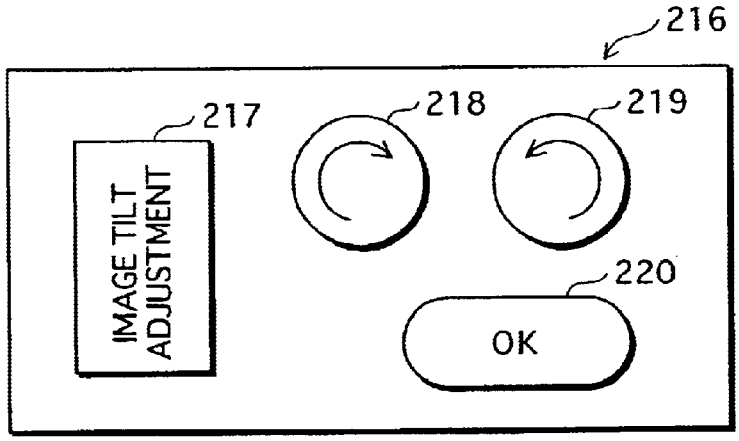
FIG. 12 shows an example of the operation unit in the image tilt adjustment unit.

FIG. 12 shows an example of input buttons provided in the operation unit 216.

When the user presses down an image tilt adjustment button 217, the image tilt adjustment unit 210 is switched to a tilt adjustment mode. While the image tilt adjustment unit 210 is in the tilt adjustment mode, the user can corrects the image tilt by operating a rotation button 218 or 219, and press down an OK button 220 for establishing the correction.

Figure 13:
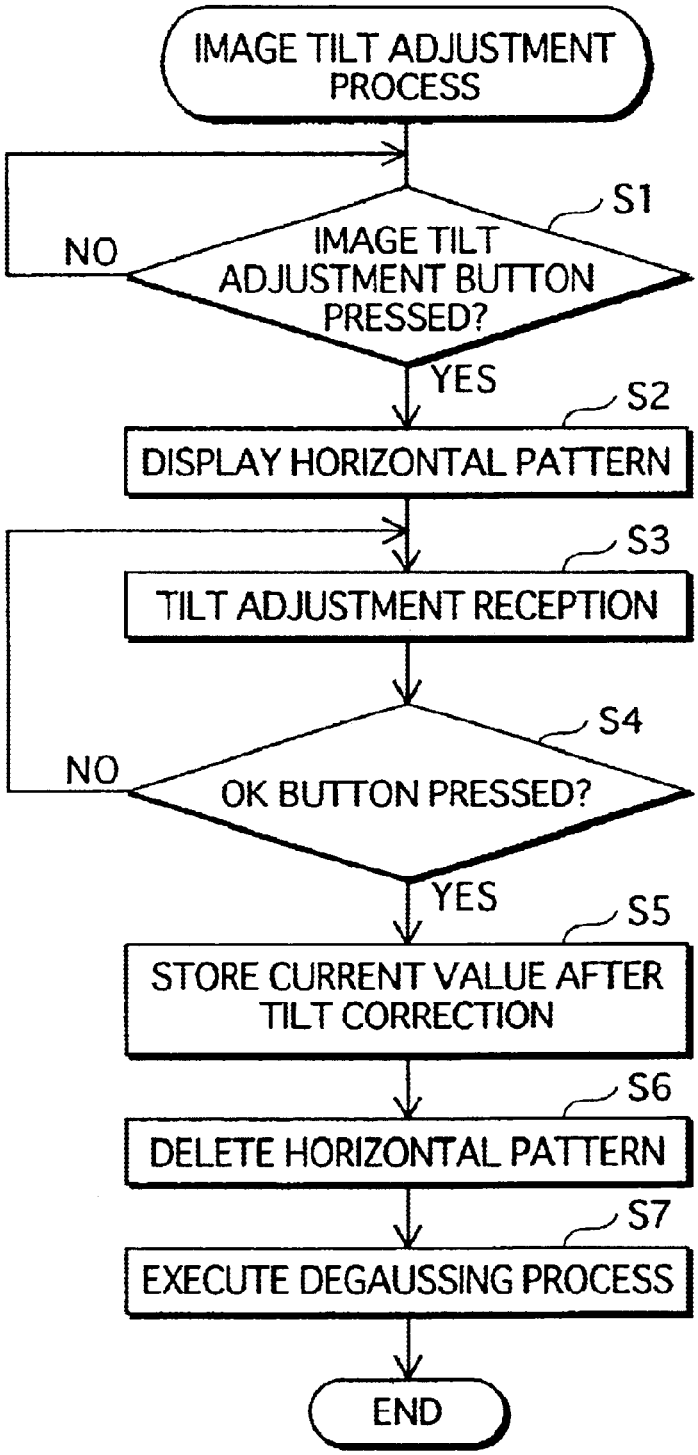
FIG. 13 is a flowchart showing the procedure of the image tilt adjustment process executed by the image tilt adjustment unit.

FIG. 13 is a flowchart showing the procedure of the image tilt adjustment process executed by the image tilt adjustment unit 210.

Figure 14:
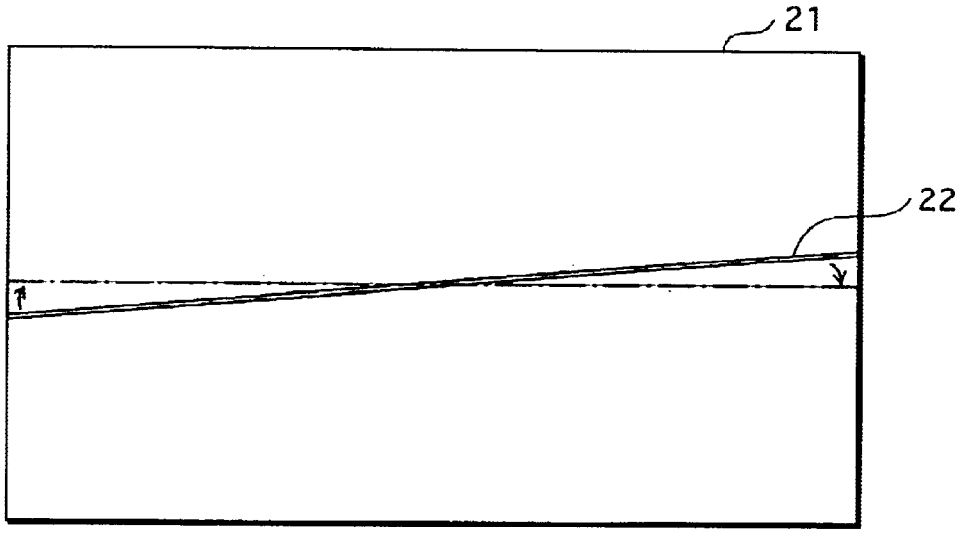
FIG. 14 shows a horizontal pattern displayed on the screen of the CRT apparatus for image tilt adjustment.

In step S1, it is judged whether the image tilt adjustment button 217 was pressed down. If it is judged affirmatively in step S1, the control moves to step S2 in which the image data of a horizontal pattern is read from the ROM 214, the read image data is sent to the image signal reception circuit 202, and a horizontal pattern 22 is displayed on the screen as shown in FIG. 14.

The image tilt adjustment unit 210 determines the amount and direction of the current supplied to the loop coil 10, in accordance with the amount of rotation of the rotation button 218 or 219 made by the user attempting to make the horizontal pattern 22 be displayed horizontally on the screen, and sends the determined amount and direction of the current to the tilt correction current supplying unit 213. This process (tilt adjustment reception process) is continued until the OK button 220 is pressed down (steps S3 and S4).

When it is judged in step S4 that the OK button 220 was pressed down, the image tilt adjustment unit 210 judges that the tilt adjustment by the user has completed, and stores a value of the current being fed through the loop coil 10 into the EEPROM 215 together with the direction of the current (step S5), and thereafter performs the image tilt correction by feeding the current of the stored value through the loop coil 10 in the stored direction.

In step S6, the horizontal pattern is deleted. With this operation, the screen is returned to the state before the image tilt adjustment process. While the screen is in this state, the degaussing process is executed (step S7).

More specifically, the degaussing current supplying unit 212 feeds an attenuation alternating current through the degaussing coils 8 and 9, allowing an attenuation alternating magnetic field to be generated between the degaussing coils 8 and 9 and degaussing the magnetic substances in the glass bulb, such as the inner magnetic shield 15 and the color-selection electrode 13.

When the degaussing process is executed after the image tilt adjustment as described above, the magnetic substances in the glass bulb 5 are degaussed even if they have been affected by the magnetic field generated by the loop coil 10. This improves the magnetic shield effect, and reduces the landing deviation.

Variations

Up to now, an embodiment of the color CRT apparatus has been described. Not limited to the embodiment, the color CRT apparatus of the present invention can be varied as follows, for example.

In the present embodiment, the loop coil 10 is formed by bending an approximately rectangular loop coil. However, not limited to this, the loop coil 10 may be formed by bending, for example, a circular or oval loop coil. It is preferable that the loop coil 10 is attached to the glass bulb 5 so as to lie along the surface thereof since there is a fear that the loop coil 10 may be deformed by some accidental contact during an assembly process or the like.

In the present embodiment, the loop coil 10 has the bent portions 101 that are bent as described in the embodiment and the attached drawings. However, the shape of the bent portions 101 may be different from the one shown in the embodiment in so far as part of the loop coil 10 projects toward the deflection yoke, achieving the purpose of correcting the landing deviation appropriately.

Also, the pair of bent portions 101 may not be symmetrical and the loop coil 10 may have only one bent portion, depending on how electron beams land.

In the present embodiment, the loop coil 10 is fixed to the degaussing coils 8 and 9 by tape 111 or the like at the intersections thereof and is thereby positioned on the glass bulb 5. This prevents the loop coil 10 from being separated from the glass bulb 5 and falling down. However, the loop coil 10 may be fixed to the degaussing coils 8 and 9 by other methods.

For example, a coil unit may be formed in advance by fixing the loop coil 10 to the degaussing coils 8 and 9, then the coil unit may be attached to the glass bulb 5 during the manufacturing of the color CRT apparatus 1. This provides a smooth work at the production line.

In the present embodiment, the loop coil 10 is adhered to the bottom of the face panel 2 by adhesive tape 112 so as to prevent the loop coil 10 from hanging down and the loop shape from deforming. However, if the above-described coil unit is adopted, the loop coil 10 may be fixed to the degaussing coil 9 at a certain position in the lower portion of the loop coil 10 when the coil unit is formed. This saves time and trouble for adhering the adhesive tape 112 on the production line.

Figure 15A:
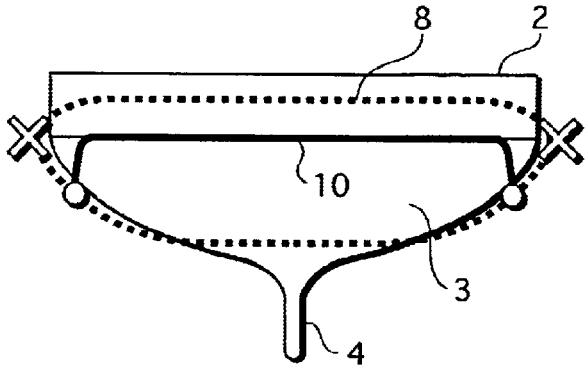
FIGS. 15A, 15B, and 15C show an example of a method of fixing the loop coil to the degaussing coil at the lower portion of the glass bulb.
Figure 15B:
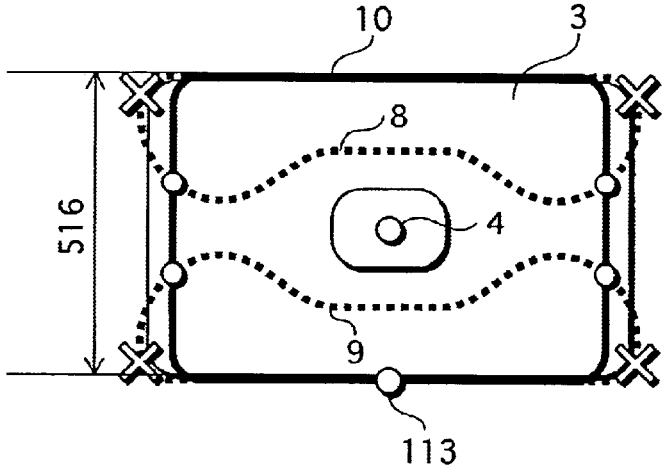
Figure 15C:
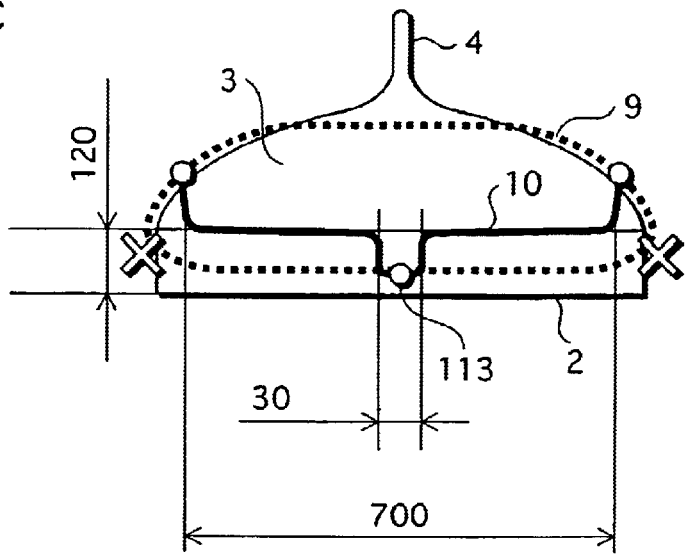
Figure 16A:
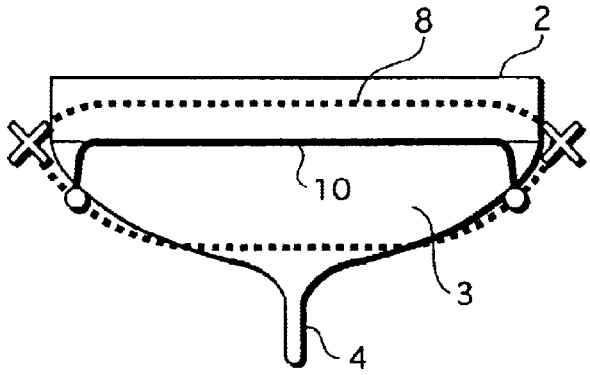
FIGS. 16A, 16B, and 16C show another example of the method of fixing the loop coil to the degaussing coil at the lower portion of the glass bulb.
Figure 16B:
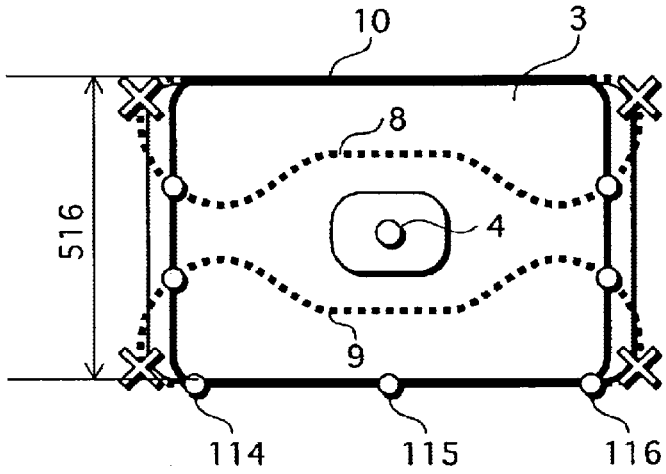
Figure 16C:
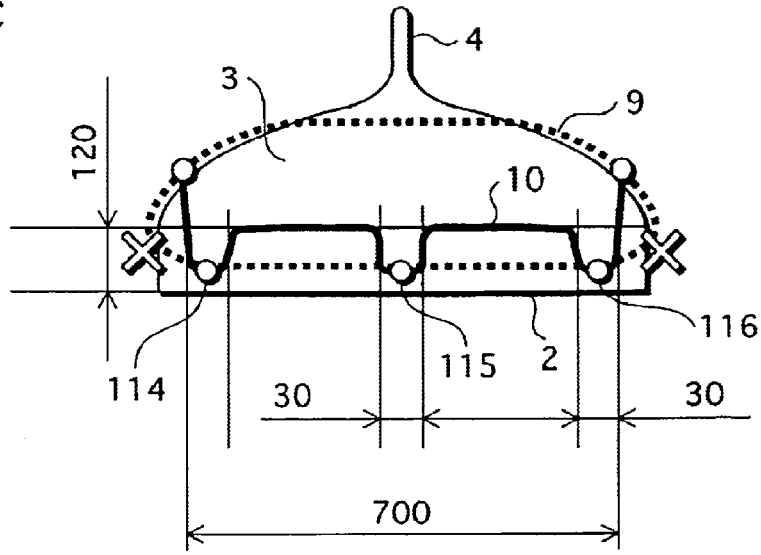

FIGS. 15A, 15B, and 15C show the first example of the above-described fixing method, and FIGS. 16A, 16B, and 16C the second example. FIGS. 15A and 16A, FIGS. 15B and 16B, and FIGS. 15C and 16C are top plan views, back views, and bottom views of a CRT to which the loop coil 10 and the degaussing coils 8 and 9 have been attached, respectively.

In each of these figures, the marks "○" indicate positions at which the loop coil 10 is fixed to the degaussing coils 8 and 9 in advance by tape or the like, and the marks "X" indicate the corners of the tensile band 7 at which the degaussing coils 8 and 9 are hooked around the ears 71. The dimensions are provided in these figures as an example, for the case where the CRT apparatus is of a 36-inch type and the aspect ratio of the screen is 16:9.

In the first example, as shown in the bottom view of FIG. 15C, the loop coil 10 is bent toward the degaussing coil 9 at approximately the center of the lower horizontal portion of the loop coil 10, and the loop coil 10 and the degaussing coil 9 are fixed to each other at the bend (reference number "113" in FIG. 15C). In the second example, as shown in the bottom view of FIG. 16C, the loop coil 10 is bent toward the degaussing coil 9 at three positions (reference numbers "114", "115", and "116" in FIG. 16C) of the lower horizontal portion of the loop coil 10, and the loop coil 10 and the degaussing coil 9 are fixed to each other at the three bends.

A coil unit with the above-described construction may be formed in advance, and then by hooking the degaussing coils 8 and 9 around the ears 71 of the tensile band 7 on the production line of the color CRT apparatus 1, attachment and positioning of the loop coil 10 and the degaussing coils 8 and 9 are done at the same time. This improves the productivity of the color CRT apparatus 1.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A cathode-ray tube comprising:

a glass bulb including a face panel, a funnel, and a neck;

a color-selection electrode which is disposed inside the face panel; and a loop coil which is disposed around the glass bulb between the color-selection electrode and a position at which a deflection yoke is to be attached, a predetermined level of direct current being fed through the loop coil, wherein the loop coil includes a first portion and a second portion, the first portion including two extending portions of the loop coil positioned over and below the glass bulb respectively, each center of the two extending portions being substantially in a plane perpendicular to a tube axial of the glass bulb, and the second portion including two bent portions that are formed by bending a right side and a left side of an original form of the loop coil toward the neck respectively.

2. The cathode-ray tube of claim 1 meeting a condition:

$1.65 \leqq 5\ b/a \leqq 10$, wherein

"a" represents a distance, along the tube axial, between (i) an intersection of an inner surface of the face panel and the tube axial and (ii) the plane, and "b" represents a distance, along the tube axial, between the plane and a reference line of the glass bulb.

3. The cathode-ray tube of claim 1 meeting a condition: $0.3\times(D/NS)+0.7 \leqq A/W \leqq 0.3\times(D/NS)+0.9$, wherein "A" represents a horizontal length of each of the extending portions of the loop coil, "W" represents a horizontal length of an effective screen of the cathode-ray tube, "D" represents an average value of an amount of landing deviation at four corners of the effective screen when current is not fed through the loop coil, and "INS" represents an average value of an amount of landing deviation at central areas of upper and lower portions of the effective screen.

4. The cathode-ray tube of claim 1 meeting a condition:

$0.08 \leqq L/A \leqq 0.16$, wherein

"A" represents a horizontal length of the extending portions of the loop coil, and "L" represents a distance along the tube axial between the plane and a position in the bent portions which is most distant from the plane along the tube axial.

5. The cathode-ray tube of claim 1, wherein a pair of degaussing coils are wound around the glass bulb, and the loop coil is fixed to the degaussing coils at intersections of the loop coil and the degaussing coils and is thereby positioned on the glass bulb.

6. The cathode-ray tube of claim 5, wherein the loop coil is fixed to one of the pair of degaussing coils that is lower at at least one position where the loop coil and the lower degaussing coil are in proximity to each other.

7. The cathode-ray tube of claim 5, wherein part of the loop coil is adhered to a bottom surface of the glass bulb by an adhesive tape.

8. The cathode-ray tube of claim 1, wherein the loop coil is attached to the glass bulb so as to lie along a surface thereof.

9. The cathode-ray tube of claim 1, wherein the color-selection electrode is supported by a frame, which surrounds the color-selection electrode, by tension, and each central area of upper and lower portions of the color-selection electrode has higher tension than four corners thereof.

10. A cathode-ray tube apparatus comprising a cathode-ray tube and a deflection yoke, the cathode-ray tube including:

a glass bulb including a face panel, a funnel, and a neck;

a color-selection electrode which is disposed inside the face panel; and a loop coil which is disposed around the glass bulb between the color-selection electrode and the deflection yoke, a predetermined level of direct current being fed through the loop coil, wherein the loop coil includes a first portion and a second portion, the first portion including two extending portions of the loop coil positioned over and below the glass bulb respectively, each center of the two extending portions being substantially in a plane perpendicular to a tube axial of the glass bulb, and the second portion including two bent portions that are formed by bending a right side and a left side of an original form of the loop coil toward the neck respectively.

11. An image display apparatus that comprises a cathode-ray tube apparatus that includes a cathode-ray tube and a deflection yoke, and displays an image on the cathode-ray tube apparatus in accordance with an image signal, wherein the cathode-ray tube including:

a glass bulb including a face panel, a funnel, and a neck;

a color-selection electrode which is disposed inside the face panel; and a loop coil which is disposed around the glass bulb between the color-selection electrode and the deflection yoke, a predetermined level of direct current being fed through the loop coil, wherein the loop coil includes a first portion and a second portion, the first portion including two extending portions of the loop coil positioned over and below the glass bulb respectively, each center of the two extending portions being substantially in a plane perpendicular to a tube axial of the glass bulb, and the second portion including two bent portions that are formed by bending a right side and a left side of an original form of the loop coil toward the neck respectively.

12. The image display apparatus of claim 11 further comprising:

an inner magnetic shield which is disposed inside the glass bulb;

an image tilt adjustment unit operable to, upon receiving an input by a user, adjust an image tilt displayed on a screen of the cathode-ray tube by varying current supplied to the loop coil; and a degaussing unit operable to degauss the inner magnetic shield and the color-selection electrode after the image tilt adjustment unit completes the adjustment of the image tilt.

13. The image display apparatus of claim 12, wherein the image tilt adjustment unit includes a pattern display unit operable to display a pattern, which should be displayed horizontally when there is no tilt of images, on the screen of the cathode-ray tube, and the user inputs instructions to the image display apparatus attempting to make the pattern be displayed horizontally on the screen.

14. The image display apparatus of claim 12, wherein the image tilt adjustment unit includes:

a receiving unit operable to receive an input by the user conveying a completion of an image tilt adjustment; and a holding unit operable to hold a value of current being fed through the loop coil when the receiving unit receives the input by the user conveying the completion of the image tilt adjustment, wherein the degaussing unit degausses the inner magnetic shield and the color-selection electrode by feeding an attenuation alternating current through the pair of degaussing coils when the receiving unit receives the input by the user conveying the completion of the image tilt adjustment, judging that the image tilt adjustment unit has completed the adjustment of the image tilt.

15. A coil unit that is attached to a glass bulb of a cathode-ray tube, comprising:

a pair of degaussing coils which are wound around an upper portion and a lower portion of the glass bulb with a tube axial of the glass bulb in between; and a loop coil which is disposed around the glass bulb between a color-selection electrode and a position at which a deflection yoke is to be attached, and includes a first portion and a second portion, the first portion including two extending portions of the loop coil positioned over and below the glass bulb respectively, each center of the two extending portions being substantially in a plane perpendicular to a tube axial of the glass bulb, and the second portion including two bent portions that are formed by bending a right side and a left side of an original form of the loop coil toward the neck respectively, wherein the loop coil is fixed to the degaussing coils at intersections of the loop coil and the degaussing coils before the loop coil is attached to the glass bulb.

16. The cathode-ray tube of claim 15, wherein the loop coil is fixed to one of the pair of degaussing coils that is lower at at least one position where the loop coil and the lower degaussing coil are in proximity to each other.

* * * * *